United States Patent [19]

Swan

[11] Patent Number: 4,702,223

[45] Date of Patent: Oct. 27, 1987

[54] DIAMOND GRINDER ASSEMBLY AND SNAP-FIT MOUNTING MEANS FOR SCARIFIER CASE

[75] Inventor: Leo Swan, Frederick, Md.

[73] Assignee: Equipment Development Company, Inc., Frederick, Md.

[21] Appl. No.: 849,969

[22] Filed: Apr. 10, 1986

[51] Int. Cl.[4] ..... F41F 1/02

[52] U.S. Cl. ..... 125/3; 51/209 R

[58] Field of Search ..... 125/3; 51/209 R, 393

[56] References Cited

U.S. PATENT DOCUMENTS

| | | | |
|---|---|---|---|
| 840,982 | 1/1907 | Williams | 51/393 |
| 2,235,446 | 3/1941 | Birger et al. | 51/209 R |
| 2,490,419 | 12/1949 | Crosby | 51/393 |
| 3,179,103 | 4/1965 | Doran | 125/3 |
| 3,464,166 | 9/1969 | Bouvier | 51/209 R |
| 3,486,274 | 12/1969 | David | 51/209 R |

*Primary Examiner*—Whitehead

*Attorney, Agent, or Firm*—Birch, Stewart, Kolasch & Birch

[57] ABSTRACT

A scarifier case for mounting on disc rotor grinders, wherein the case is designed to snap attach and quick disconnect selected grinder inserts in the case without requiring the case to be removed from the rotor disc to change a selected grinder insert.

5 Claims, 4 Drawing Figures

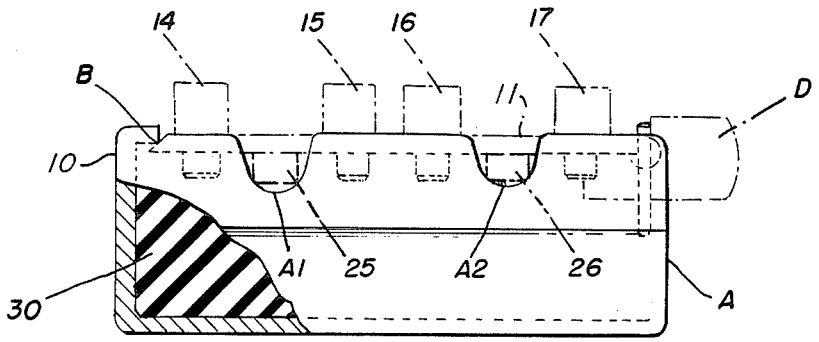
FIG. 1
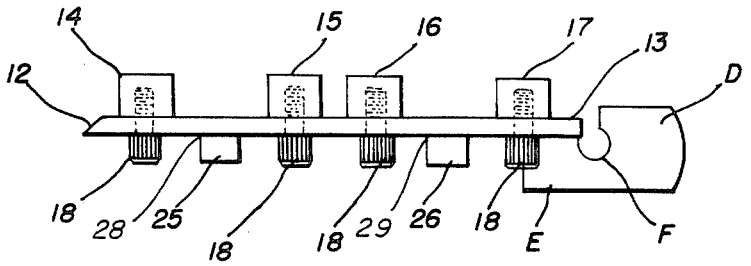
FIG. 2
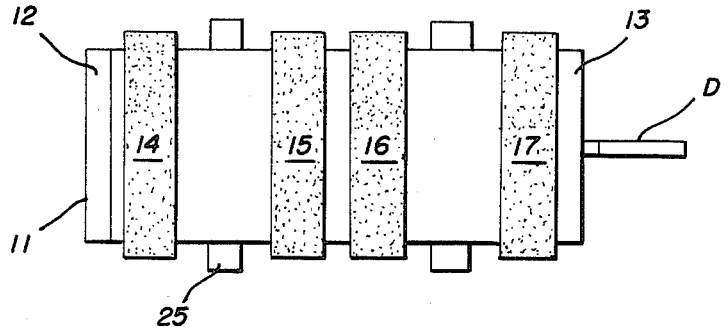
FIG. 3
FIG. 4
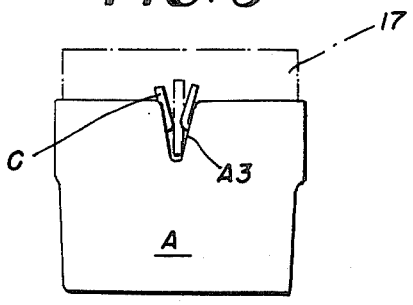

DIAMOND GRINDER ASSEMBLY AND SNAP-FIT MOUNTING MEANS FOR SCARIFIER CASE

BACKGROUND OF THE INVENTION

The present invention relates to industrial surfacers such as powered disc grinders to provide highly versatile performance in the cleaning, smoothing and beaufifying of concrete slab surfaces and the like.

U.S. Pat. No. 3,179,103 to Doran issued Apr. 20, 1965, and assigned to the same assignee as the present invention, teaches the use of disc grinders for treating and refinishing all forms of slabs, flooring and the like by utilizing various scarifier mounting casings disposed on the rotatable disc of the grinder. The scarifier of Doran includes a quick-connect structure associated with each case for interchanging scarifier spurred disc assemblies.

It has been found that the case of Doran needs some modifications for housing other types of grinders, such as the unique diamond grinding assembly of the present invention. For example, because of the hardness of the diamond segments, it is desirable to provide a shock absorbing cushion in the case to damp vibrations and more securely contain the grinding assembly.

SUMMARY OF THE INVENTION

Accordingly, it is a primary object of the present invention to provide an improved mounting means for interchangeable grinder assemblies to be mounted in scarifier cases of grinding discs.

It is another object of the present invention to provide a mounting means which damps vibrations from diamond grinders having extremely hard surfaces.

The objects of the present invention are fulfilled by providing a scarifier case having bottom, side and end walls for a grinder accessory, said end walls having retainer means for said accessory, a solid rubber block in said case having inherent resiliency, said accessory including a plurality of diamond impregnated blocks secured to a flat metal base in the provision of a grinding insert assembly, said assembly being mounted on said rubber block and retained in said scarifier case by said retainer means of said end walls, and positioning means transverse the side of the said flat metal assembly opposite to said diamond impregnated blocks in compressed engagement with said solid rubber block when retained in said case by said retainer means of said end walls, to thereby permit the unit to become activated as a grinder accessory.

BRIEF DESCRIPTION OF THE DRAWINGS

The objects of the present invention and the attendant advantages thereof will become readily apparent by reference to the drawings wherein:

FIG. 1 is a side elevational view of a scarifier case with a novel cushioned diamond grinding insert assembly shown in position and the novel snap-action detachable mounting thereof in phantom lines;

FIG. 2 is a diamond grinding assembly shown prior to snap mounting the same in the scarifier case in side elevation;

FIG. 3 is a top plan view of the diamond grinding insert assembly per se; and FIG. 4 is an end elevational view of the scarifier case and a spring clip and coacting slot formed in an end of the case.

DETAILED DESCRIPTION OF PREFERRED EMBODIMENTS

As shown in FIG. 1, the novel grinding assembly 10 comprises a flat, rectangular plate 11 preferably made of suitable metal. This plate is formed with a front outboard bevel end 12 and a rear end edge 13. The plate 11 is a mounting unit for assembly thereto of a plurality of transversely spaced members such as diamond grinding segments 14, 15, 16 and 17, see FIGS. 2 and 3. Each of these grinding segments (diamond impregnated blocks) are suitably attached to the flat metal base plate 11.

The means of attaching the several diamond grinding segments may be by any method that fits the job requirements, as shown in FIG. 2 by set screws 18, 19, 20; silver solder; or a laser weld, see FIG. 2.

Mounted on the underside or inboard side of the plate 11 are spaced position locating bars 25 and 26, see FIGS. 1 and 2. These spaced bars 25 and 26 are secured to the inboard face of the flat plate 11 by a solder or weld 28–29, see FIG. 2, and extend downward into the scarifier case A and compress a yieldable compression pad 30, see FIG. 1.

The scarifier case A is formed with a transverse lip or flange B which coactively engages under the lip B of the case A and is held therein by compression of the position locating bars 25 and 26, and by a spring clip C and a mounting wedge D formed with a nose E, continuing from a cut-out F to form a retaining hole to detachably connect to the rear end edge of the plate 11, see FIG. 2. The wedge D extends from the retaining hole of cutout section F and is frictionally engaged by the spaced, yieldable tines or sides of the clip C adjacent slot A3.

As shown in FIG. 1, the scarifier case A houses the compression pad 30 formed from a resilient material such as Neoprene, rubber or any desirable resilient substance to provide a shock absorbing cushion for the diamond grinding insert assembly during use of the grinder. Extending from the inboard side of the plate 11 are the position locating bars 25 and 26. As shown in FIG. 1, these locating bar members seat compressively and press into the resilient compression pad 30 in the case A until they set in the bottom of slots A1 and A2. Thus, in effect there is provided a quick change, snap-fit system enabling the user to use various other accessories in the same cushion loaded scarifier box, as desired or necessary to fit the job requirements.

Without further details of the foregoing description in conjunction with the drawings, it is believed that the use and operation of the present novel diamond grinding insert assembly is apparent, and the advantages of the present, novel quick-change system and anti-shock absorbing vibrations imparted from the grinding equipment is clearly explained.

What is claimed is:

1. A case for suitable attachment to the rotor disc of a grinder, in combination with an insert grinding assembly, comprising a rectangular flat plate having an outboard side and an inboard side, said plate having quick connection means at each opposite end between the walls of the case and the opposite ends of the said plate, wherein the case wall at one end is formed with an inturned lip coacting with an outboard end of the flat plate to thereby permit engagement under said lip, wherein the improvement, comprises:

a compressible block for positioning within the case to yieldably resist depression of the plate when it is engaged under said lip thereby urging the end to engage upwardly against the underside of said lip, said compressible block being substantially coextensive with the inboard side of said plate; and a plurality of segments having selected grinding properties secured to the outboard side of said flat plate.

2. A case as described in claim 1, wherein the said segments are formed of diamond grinding material.

3. A case as described in claim 1, further comprising:

position locating means secured to the inboard side of said plate for positioning said insert grinding assembly against said compressible support means.

4. A case as claimed in claim 3, wherein said position locating means comprises transversely spaced bars extending from the underside of the said plate and engaging said compressible support means.

5. A case as described in claim 1, wherein said compressible block is rubber.

* * * * *